United States Patent [19]

Willard

[11] 4,027,439

[45] June 7, 1977

[54] FLOOR SUPPORT FOR SECTIONALIZED BUILDINGS

[76] Inventor: Robert Willard, 56044 Riverdale Drive, Elkhart, Ind. 46514

[22] Filed: Aug. 10, 1976

[21] Appl. No.: 713,297

[52] U.S. Cl. ..... 52/79.1; 52/264; 52/274; 52/293; 52/299; 52/480; 52/691; 52/696

[51] Int. Cl.[2] ..... E04B 5/14; E04C 3/292

[58] Field of Search ..... 52/274, 264, 265, 293, 52/299, 643, 693, 692, 690, 79, 480, 696, 691

[56] References Cited

UNITED STATES PATENTS

| | | | |
|---|---|---|---|
| 2,042,797 | 6/1936 | Nechin | 52/584 X |
| 2,255,315 | 9/1941 | Hailton | 52/264 X |
| 2,372,768 | 4/1945 | Davison | 52/299 X |
| 2,439,960 | 4/1948 | Auten | 52/293 X |
| 2,783,718 | 3/1957 | Cheshire | 52/691 X |
| 2,904,849 | 9/1959 | Bergstrom | 52/299 X |
| 3,188,694 | 6/1965 | Hammar | 52/480 X |
| 3,345,792 | 10/1967 | Chandler | 52/691 X |
| 3,712,004 | 1/1973 | Loebsack | 52/265 |
| 3,853,162 | 12/1974 | Menge | 52/691 X |
| 3,913,286 | 10/1975 | Boutacoff | 52/79 X |

FOREIGN PATENTS OR APPLICATIONS

| | | | |
|---|---|---|---|
| 842,388 | 7/1960 | United Kingdom | 52/274 |

*Primary Examiner*—Leslie Braun
*Attorney, Agent, or Firm*—Oltsch & Knoblock

[57] ABSTRACT

Flooring for a sectionalized building which includes spaced parallel girders supported upon a concrete foundation carrying cross beams. Joists are supported upon each of the girders with a pair of board supports being positioned at the side edges of each of the girders and extending from the top of the joists to the cross beams. Flooring is applied over the joists and board supports.

5 Claims, 8 Drawing Figures

FLOOR SUPPORT FOR SECTIONALIZED BUILDINGS

SUMMARY OF THE INVENTION

This invention relates to a building having sectionalized components and will have particular application to the floor sections utilized in each building component.

In the sectionalized building of this invention, each building component will generally include a floor section, side walls and roof parts. The component is brought to the building site and placed upon a concrete foundation to be joined to other building components. The floor section of each building component includes a girder having joists and flooring applied thereover. Along the side edges of each of the girders are positioned board supports which extend lengthwise of the floor section. Each girder is supported on cross beams extending from one side wall to the other of the building foundation with the board supports of each floor section being supported by either the cross beams or the foundation side walls. In this manner, adjacent floor sections of the building components may be joined at their respective board supports as well as being connected to the supporting cross beams to fully support the building components. In the design of the sectionalized floors of this invention, the girders and board supports at each end thereof cooperate in conjunction with the underlying cross beams and concrete foundation to provide a unified firm supporting structure for the building components.

Accordingly, it is an object of this invention to provide a firm, rigid floor support for sectionalized buildings.

Another object of this invention is to provide a building having floor supports which in sectionalized form cooperate in such a manner to provide a unified and rigid building.

Still another object of this invention is to provide a floor for a sectionalized building having cooperating components which form an economical and rigid building support.

Other objects of this invention will become apparent upon a reading of the invention's description.

BRIEF DESCRIPTION OF THE DRAWINGS

A preferred embodiment of this invention has been chosen for purposes of illustration and description wherein.

DESCRIPTION OF THE PREFERRED EMBODIMENT

Figure 1:
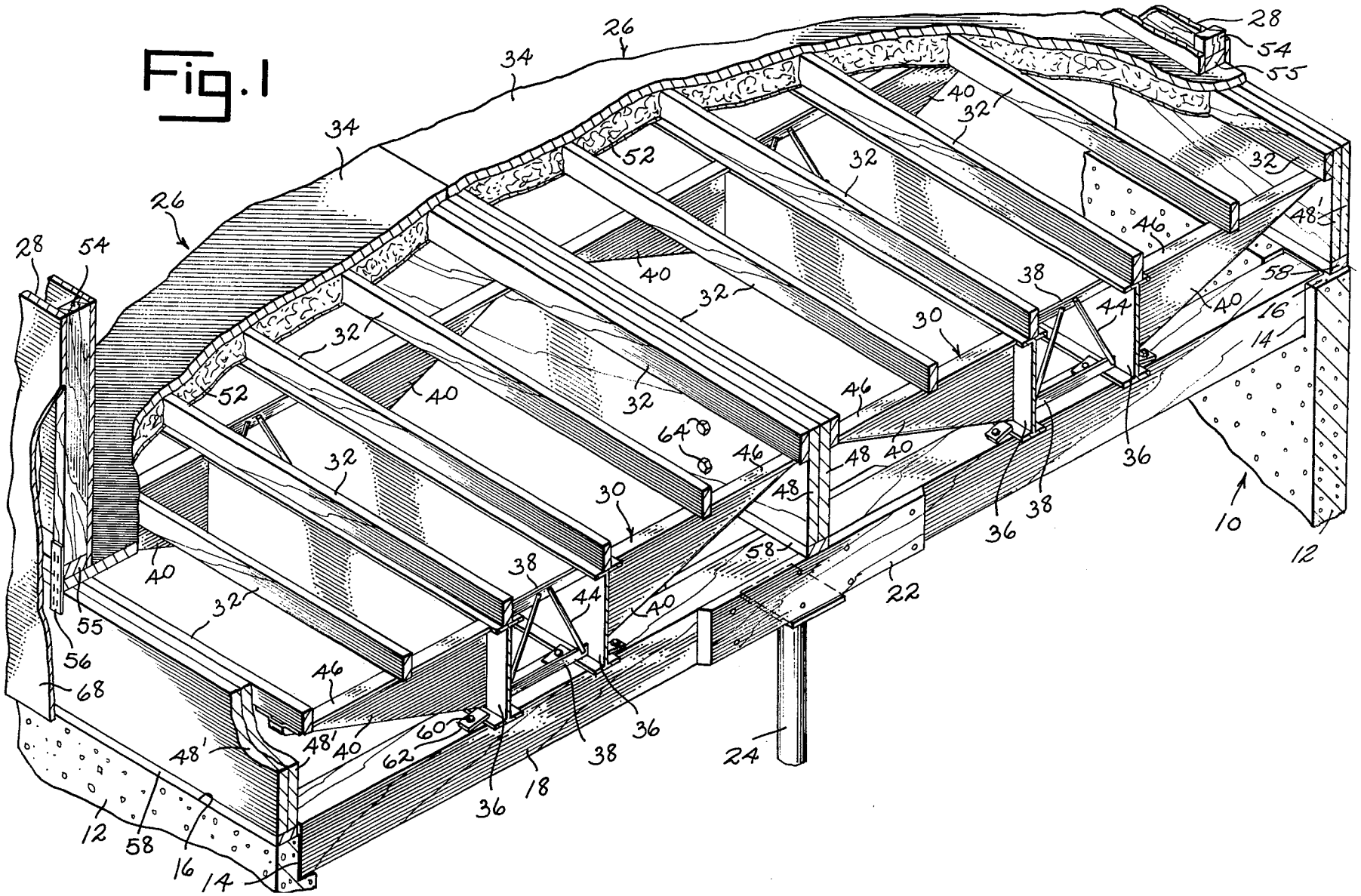
FIG. 1 is a perspective view of the floor support of a sectionalized building with portions of the support broken away for purposes of illustration.
Figure 2:
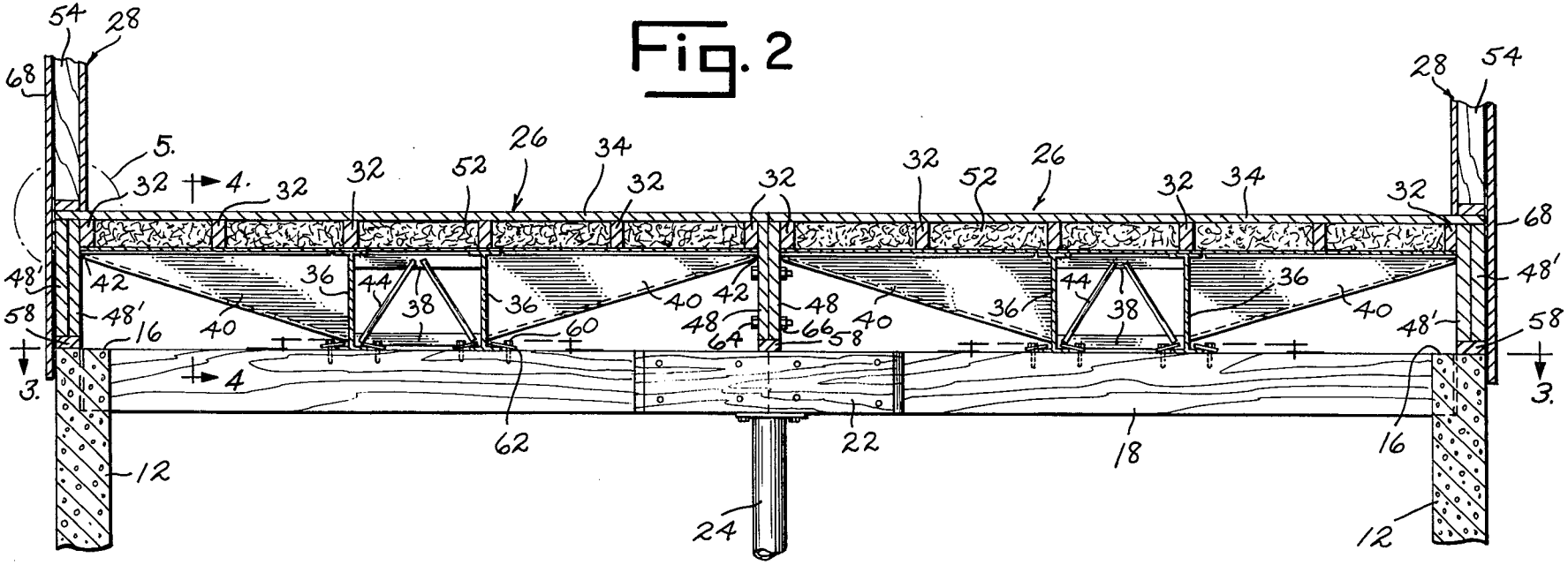
FIG. 2 is a cross sectional view of the floor support of FIG. 1.
Figure 3:
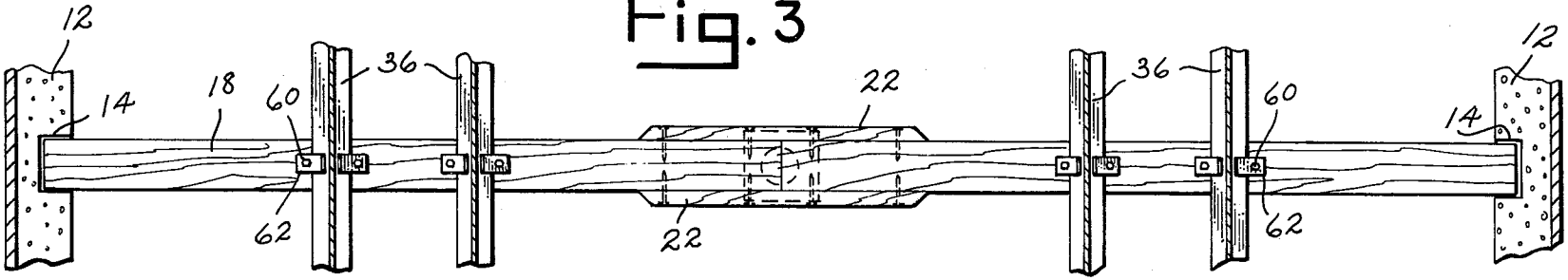
FIG. 3 is a sectional view taken along line 3—3 of FIG. 2.
Figure 7:
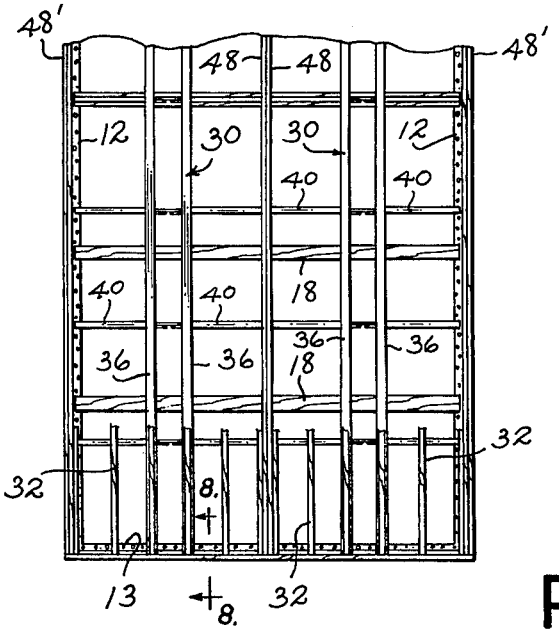
FIG. 7 is a plan view of the floor support.
Figure 4:
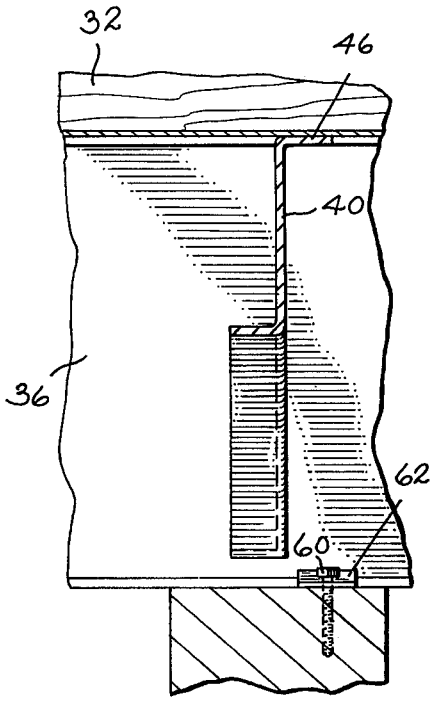
FIG. 4 is a sectional view taken along line 4—4 of FIG. 2.
Figure 8:
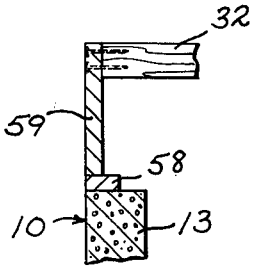
FIG. 8 is fragmentary sectional view taken along line 8—8 of FIG. 7.
Figure 6:
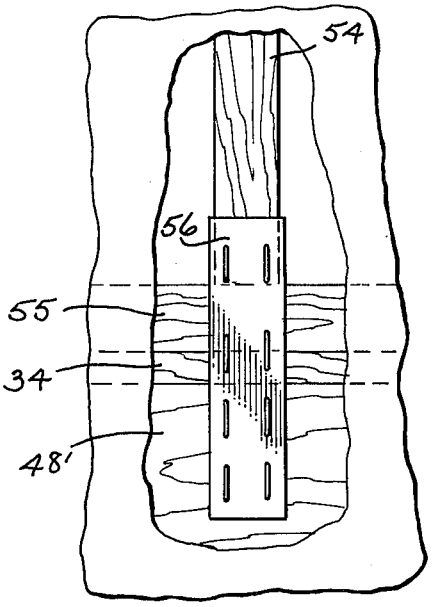
FIG. 6 is an elevational view seen from line 6—6 of FIG. 5.
Figure 5:
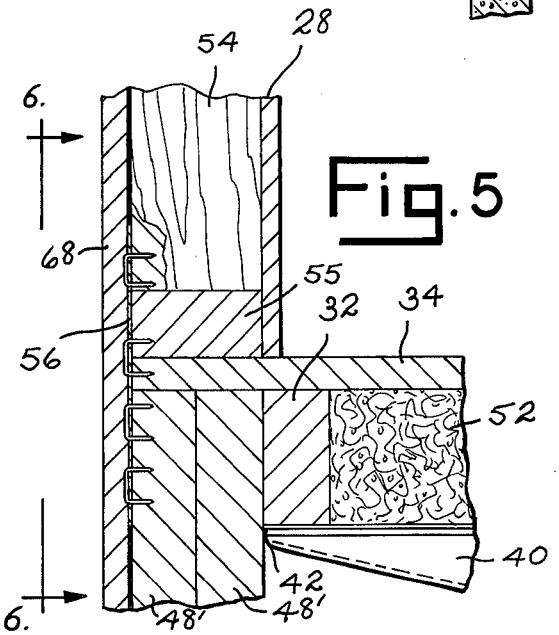
FIG. 5 is an enlarged detailed view of that portion of the floor support as seen within broken circular line 5 of FIG. 2.

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

The sectionalized building depicted in the figures includes a concrete foundation 10 which extends upwardly from the ground. Foundation 10 may be of block or poured form and includes side walls 12. Pockets 14 are formed within side walls 12 along upper edges 16 of the side walls. Parallel cross beams 18 extend from one side wall 12 to the other side wall 12 of foundation 10 and have their end portions fitted supportedly within oppositely located pockets 14. Cross beams 18 may be wooden or, if desired, of steel I-beams or similar form. In the illustrated embodiment each cross beam 18 is of a wooden construction formed of two beam parts connected by nailed overlapping connector boards 22. The spacing between cross beams 18 can vary from construction to construction with the normal spacing being ten to twelve feet. A jack post 24 resting upon the foundation floor, in the case of a full basement, or a concrete pad or block, in the case of a crawl space, contacts the center of each cross beam 18 to support the beam.

The sectionalized building includes at least two interconnected components each having a floor section 26 and side walls 28 which usually in turn support a roof section (not shown). The building components are placed side by side upon cross beams 18 and side walls 12 of foundation 10 and are suitably joined with roofing material and siding being applied over the joined areas of the building.

Each floor section 26 of the building component includes a girder 30 formed of steel over which are applied joists 32 and flooring 34. The girder 30 of each floor section includes spaced parallel I-beams 36 connected together by upper and lower transverse bars 38. Gussets 40 extend outwardly from opposite sides of I-beams 36 in cantilever fashion. For a girder 36 to 60 feet long, depending upon the size of the building component, gussets 40 will be spaced approximately four feet apart along I-beams 36. The width of girder 30 when measured across gusset tips 42 may be between 12 and 14 feet. Diagonal rods 44 can be welded between bars 38 of girder 30 to provide the additional strength for the girder. Each gusset 40 is preferably Z-shaped in cross section with the upper flanges 46 of the gussets and the tops of I-beams 36 being substantially coplanar so as to provide a level surface for supporting joists 32. From manufacturer to manufacturer of sectionalized buildings, the precise construction of girders 30 will vary with each girder commonly having a main supporting center section which extends longitudinally of the building component and oppositely extending gussets which are attached to the main girder center section and extend outwardly therefrom in cantilever fashion.

Joists 32 of each floor section 26 are equally spaced apart with one joist overlying one tip 42 and another joist overlying the other tip 42 of each pair of opposite gussets 40 of the floor section girder. Screws or other similar securement members may be turned through flanges 46 of gussets 40 and into the overlying wooden joists 32 to secure the joists to the girder. Extending the length of each girder 30 at each side of the girder along tips 42 of gussets 40 is a board 48,48'. Each board 48,48' is connected to the adjacent joist 32 overlying gusset tips 42 and extends in width at its upper edge to the level of the upper surfaces of joists 32 of the floor section. An additional board 48' is preferably carried along each girder 30 at the outside of the floor section. If desired, a single board having a double thickness can be carried along the outside longitudinal edge of each floor section instead of the two boards 48' of smaller thickness as illustrated. Flooring 34 is applied over the upper edges of joists 32 and boards 48,48' of each floor section 26. Studs 54 and base strips 55 of side walls 28 are carried upon flooring 34 over the two boards 48' at the outside edge of each floor section. Each stud 54 and base strip 55 may be attached to underlying flooring 34 or boards 48' by a number of ways, such as metal straps 56 which are stapled or otherwise secured to the stud, flooring, strips and boards. If desired, insulation 52 may be placed between joists 32 within the space between flooring 34 and the upper surfaces of gussets 40 and I-beams 36 of each floor section.

With cross beams 18 supported upon foundation side walls 12 and by jack posts 24, each sectionalized building component is lowered or slid into position with its girder 30 resting upon cross beams 18. Boards 48 at the inside of the building components are positioned side by side in a juxtaposed relationship with the edges of flooring 34 in abutment. Boards 48' at the opposite edges of each floor section 26 are located over side walls 12 of foundation 10. Wooden sill plates 58 are nailed to the lower edges of boards 48,48' and band joists 59 nailed to the ends of joists 32. Sill plates 58 rest upon cross beams 18 and foundation upper edges 16 to cause the adjoining floor sections 26 of the building components to be fully supported with flooring 34 being level and coplanar at five support points located along each beam and its supporting foundation side walls 12. Each board 48,48' as well as underlying plate 58 constitutes a board support for the side edges of each floor section 26. Sill plates 58 attached to band joists 59 rest upon end walls 13 of foundation 10. Lag bolts 60 and retainer plate 62 are utilized to secure each girder 30 to cross beams 18. This is accomplished by inserting each lag bolt 60 through an opening in a retainer plate 62 and turning the lag bolt into the underlying beam with the retainer plate overlapping and clamping the lower flange of each girder I-beam 36 against the underlying cross beam. The juxtaposed boards 48 of the adjoining floor sections are secured together at periodic intervals along the length of the floor section by bolts 64 and nuts 66. Applied to the outside of side walls 28 is siding 68, with the lower marginal edge of siding 68 preferably overlapping side walls 12 of foundation 10.

As used in the description and claims, the term "sectionalized building" will include homes and office structures.

It is to be understood that the invention is not to be limited to the details above given, but may be modified within the scope of the appended claims.

What I claim is:

1. In a sectionalized building having two joining components, each component including a floor section and side walls, a ground supported foundation, each building component carried upon said foundation, the improvement wherein said foundation includes side walls, a plurality of parallel spaced cross beams each carried by and extending from one said foundation wall to the other, each floor section including:

a girder extending longitudinally of the floor section, said girder including a center beam part and a plurality of longitudinally spaced cantilevered transverse gussets extending from opposite sides of said beam part and terminating at reduced end portions, spaced joists carried upon said gussets paralleling the beam part of said girder and having upper surfaces lying in approximately the same plane, a pair of spaced board supports each paralleling said joists at the end portions of said girder gussets, each board support extending from the plane of said joist upper surfaces to approximately the level of the bottom of said girders, flooring applied over said joists and board supports, said floor section of one component and said floor section of the other component positioned side by side with the respective girders of each section resting upon said cross beams, one board support of one floor section and one board support of the other floor section being juxtaposed, said juxtaposed board supports carried by said cross beams, the other of said board supports of the floor sections carried by said foundation walls.

2. The sectionalized building of claim 1 and means for securing said girders to said cross beams.

3. The sectionalized building of claim 2 wherein said flooring of the floor sections has substantially coplanar upper surfaces and abut at said juxtaposed board supports, and means for securing said juxtaposed board supports together.

4. The sectionalized building of claim 3 wherein each board support of a said floor section is positioned next to a joist of the floor section.

5. The sectionalized building of claim 3 including wall structures carried upon siad floor sections above said other board supports.

* * * * *